US005987676A

United States Patent [19]

Littleford et al.

[11] Patent Number: 5,987,676

[45] Date of Patent: Nov. 23, 1999

[54] VARIABLE SUPPORT PILLOW

[76] Inventors: John A. Littleford; Claudia D. Littleford, both of 1776 South Jackson, Suite 907, Denver, Colo. 80210

[21] Appl. No.: 09/010,924

[22] Filed: Jan. 22, 1998

[51] Int. Cl.[6] ..... A47C 20/02; A47C 20/08

[52] U.S. Cl. ..... 5/636; 5/640; 5/657; 5/722

[58] Field of Search ..... 5/636, 632, 640, 5/722, 657, 490, 738

[56] References Cited

U.S. PATENT DOCUMENTS

| | | | |
|---|---|---|---|
| 3,276,046 | 10/1966 | Capelli | 5/640 |
| 4,689,844 | 9/1987 | Alivizatos | 5/632 |
| 5,363,524 | 11/1994 | Lang | 5/640 |
| 5,528,784 | 6/1996 | Painter | 5/640 |
| 5,781,947 | 6/1998 | Sramek | 5/640 |

*Primary Examiner*—Michael F. Trettel
*Assistant Examiner*—Fredrick Conley
*Attorney, Agent, or Firm*—Ramon L. Pizarro; Edwin H. Crabtree

[57] ABSTRACT

An apparatus and method for treating problems associated with improper support of the head relative to the spine and shoulder girdle. The apparatus and method including providing an adjustable a series of stackable pillow cushion for supporting a user's head in a desired relationship to the user's body, each pillow cushion including a body with a pair of substantially parallel surfaces, one of the surfaces having a first recessed area and at least two areas of firm support. Then placing the areas of firm support generally opposite to one another and next to the recessed areas, and stacking at least two pillow cushions over one another with the areas of firm support aligned over one another to adjust the height of the support of the stack of cushions and the height of the support of the head relative to the spine and shoulder girdle.

15 Claims, 4 Drawing Sheets

VARIABLE SUPPORT PILLOW

BACKGROUND OF THE INVENTION (a) Field of the Invention

This invention generally relates to a pillow system which allows the user to adjust the height, or thickness, of the pillow by folding the components of the pillow. More specifically, but not by way of limitation, to a pillow formed from several sections. Each section being adapted for folding over the other section to allow the user to adjust the thickness of the pillow.

(b) Discussion of Known Art

Widely available pillows typically consist of a rectangular fabric casing that has been filled with some sort of cushion material, such as soft foam, feathers, cotton bunting and the like. While these pillows have been widely accepted for many years, they leave many important problems unresolved. One important problem is brought on by the fact that a person is likely to change positions while sleeping, and the appropriate distance for the support of the head from the surface of the mattress or sleeping surface varies with the person's position. The failure to properly support the head relative to the mattress or sleeping surface while sleeping results in problems such as strained muscles, shoulder pain, headaches, etcetera, as well as other problems associated with insufficient support.

To achieve the needed rest and skeletal support it is essential that the person's head be supported in a proper position relative to the rest of the body. The head, neck and shoulder girdle needs to remain in a relatively neutral position in order to avoid problems such as headaches, neck and shoulder problems due to muscular/skeletal malalignment. Specifically, when lying on one's side, it is very important to ensure that the head remains in-line with the spine. Moreover, if a person is lying on his side, it is also important to support the head in a position that allows the neck to remain along a line that is substantially normal to a line between the person's shoulders. Deviations from this posture will lead to disturbed sleep patterns, as well as problems associated with skeleton and muscle interaction.

Similarly, when a person sleeps on his back, the head should be supported at a position that allows the person's head to be supported at slight angle to the horizontal and at a small distance from the plane of the person's body. Again, support that allows the individual's posture to vary from this ideal positioning can lead to chronic problems.

The need for proper support of the person's head relative to the body while sleeping has long been recognized. However, known pillows and support devices have not been able to solve the problems associated with proper support of the head while sleeping. An example of known devices is shown in U.S. Pat. No. 395,043 to Doremus, where a pillow and multi-pocket slip are taught. The multi-pocket slip of the Doremus device includes pockets that have been attached to one another along a common line, so that the pockets extend from one another in a generally radial manner. The Doremus device allows the user to vary the thickness or height of the pillow below the user's head, and thus may support the user's head at a desired position relative to the plane on which the body rests. However, the Doremus device suffers from several important limitations. One important limitation is that the radial arrangement of the pockets of the case or slip permits the stacking of a limited number of pillow components. As the number of pillows or components being stacked increases, the greater the tendency that the uppermost component or pillow will remain at an angle relative to the point where the pockets are joined and the plane of support of the body. Additionally, the cushions or individual pillows used with the Doremus device can be combined in arrangements that use adjacent compartments. Therefore, if the user wishes to modify the stack combination, he would have to remove the individual pillows from the slip and rearrange them so that the desired pillows will be housed in adjacent pockets of the slip.

Additionally, the configuration of the Doremus invention is further disadvantaged in that the fill of the individual sections is likely to shift with use of the pillow. Once the fill of a particular pillow has shifted, the user must either rearrange the fill by pounding on the areas where the fill has settled or add another pillow from radial arrangement. The former solution is very disturbing to the ability to obtain proper night's sleep, while the latter offers a limited solution in that the second pillow will collapse into the cavity in the lower pillow, and the shifting of material will then begin on the second pillow.

In the art of mats, or coverings for chaise loungers and the like, artisans have approached the problems associated with the need to vary the thickness of a cushion has by attaching the cushions in series. The attachment of cushions in series has been popular in area of mats and cushions for chaise loungers due to the fact that these cushions must be capable of covering a long lounger or acting as a small mattress type pad to provide support under the entire body. Unfortunately, however, these devices provide little guidance to the artisan on how to solve the problems associated with varying the support of the head relative to the body when varying the position of the body over a planar surface such as a bed. For example U.S. Pat. No. 2,834,970 to Nappe teaches a sealed pad that includes several cushions attached in series. The Nappe invention is particularly well suited for solving the problems associated with the permanent compaction of the mat and the absorption of moisture by the mat, but giving little clue to the ordinary artisan as to how to use a set of cushions attached in series to vary the support of a person's head relative to the body.

Another cushioned mat is taught in U.S. Pat. No. 3,323,151 to Lerman. The Lerman device includes several foam pads connected in series. The Lerman pads are joined and sealed by means of a skin formed from the foam material by means of heated dies. Like the Nappe device, the Lerman device is particularly well suited for functioning as a seat cushion or a body support mat. However, the problems associated with the support of the head while sleeping are not addressed. This is probably due to the fact the field of mats or chaise cushions does not deal with the problems faced in the art of pillows, which involve orthotic considerations which are not necessarily dealt with in the field of mats or chaise cushions.

Still another known device is taught in U.S. Pat. No. 3,336,610 to Geddings. The Geddings device is yet another flat mat constructed of sections joined in series. The construction of the Geddings device is similar to the construction of the device taught in U.S. Pat. No. 5,491,851 to Alonso or U.S. Pat. No. 5,066,001 to Wilkinson. These devices are suitable for serving as mats for exercise or as cushions for chaises or the like, but, again, offer little guidance in solving the orthotic problems associated with supporting the head relative to the body during rest.

Still another device that uses cushions in series is taught in U.S. Pat. No. 4,606,087 to Alivizatos. The Alivizatos device includes several pockets that accept bead filled cushions. A significant feature of the Alivizatos device is that it combines the function of an infant support device with the functions of a carrying bag. The Alivizatos device, however, does not address the problems associated with providing proper support for the head while sleeping.

Thus, a review of known devices reveals that there remains a need for a pillow that allows variation of height of the support for the user's head relative to his body. Importantly, there remains a need for an adjustable pillow that allows the user to vary the height at which the head is supported relative to the user's body without having to dismantle the device during the night.

Still further, there remains a need for a stable pillow that allow for proper support and accommodates the natural contours of the user's anatomy to prevent muscolo/skeletal problems.

Importantly, known devices have not addressed the need for an orthotic pillow that provides proper orthopedic support and maintains alignment of the user's head, neck, and upper body shoulder and spine relationship.

SUMMARY

It has been discovered that the problems left unanswered by known art can be solved by providing a pillow system that includes the following elements:

a) a flexible support for holding a plurality of cushions in series; and b) a plurality of pillow cushions having a body and a recessed area for receiving the user's head/ear.

A preferred embodiment of the invention the body of each pillow cushion includes a perimeter of sufficient structural rigidity so as to allow the formation of a stack of cushions. The center portion of these cushions, however, include a recessed area. Additionally, in a preferred embodiment of the invention, the mid portion of the cushions will be of a smaller cross-sectional area than the ends of the pillow cushions. It has been discovered that this configuration allows stable stacking of the pillow cushions that allows the user to maintain stable support and alignment of the user's head, neck, and upper body shoulder and spine, especially when using soft, easily deformable materials for the area of the cushion which receives the head.

It is contemplated that the body of the pillow cushions may be made from foam or similar material. Alternatively, it is contemplated that the perimeter of the body of the pillow may be formed from relatively densely packed cushion material, such as densely packed feathers, batting, matting material, or other known soft, deformable materials.

It has been discovered that by providing a pillow system that provides cushions that accept and support the contours of the body, and allows stacking of the individual cushions, one may solve problems left unsolved by the known devices. For example, by providing a recess in the pillow cushion, the disclosed invention maintains proper alignment of the head relative to the neck, spine and shoulders. Additionally, by allowing stable stacking of the individual cushions one also supports the head at the proper orientation relative to the neck, spine and shoulders. Conventional pillows are typically uniformly filled with a soft, deformable material to form a roll or tube having a generally uniform cross-section with the thickest section of the pillow being at its center. The generally rounded shape of the conventional pillow does not lend itself to stacking.

The disclosed invention allows stacking and provides cushions with a contoured section at approximately the mid portion of the cushions. The contoured portion includes a recess in the surface of the cushion and most preferably it produces new and useful results in support and adjustability that could not be achieved with known devices. In particular, the disclosed invention produces new and useful results in the support of the head relative to the neck, spine and shoulders.

Thus it will be appreciated that the disclosed invention solves the problems with known pillows and cushions by providing stable adjustability of the thickness of the pillow's support.

It will also be appreciated that the disclosed invention includes a flexible support for holding a plurality of cushions, each cushion having a body and a recessed area for receiving the user's head/ear allows, the multiple pillow cushions being held in an easily adjustable format during sleep. The format being provided in large part by the structure of the pillow case and cooperating cushions which allow the user to vary the thickness of the stack quickly and with little effort. Thus the instant invention allows the user to vary the thickness of the stack in the middle of the night, without causing significant disturbance to the user's sleep.

Still further, it will be appreciated that the instant invention allows the use of stable pillow cushions while providing the comfort of soft fill pillows.

Still further, it will be appreciated that the disclosed pillow system allows the user to vary the thickness of the support and vary the configuration of the system to allow use of the system as a seat and back rest. Thus the disclosed invention achieves new, synergistic, results that are not achievable with known configurations.

It should be understood that the disclosed invention also includes a method for treating problems associated with improper support of the head relative to the spine and shoulder girdle. The method including providing an adjustable a series of stackable pillow cushion for supporting a user's head in a desired relationship to the user's body, each pillow cushion including a body with a pair of substantially parallel surfaces, one of the surfaces having a first recessed area and at least two areas of firm support. Then placing the areas of firm support generally opposite to one another and next to the recessed areas, and stacking at least two pillow cushions over one another with the areas of firm support aligned over one another to adjust the height of the support of the stack of cushions and the height of the support of the head relative to the spine and shoulder girdle.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
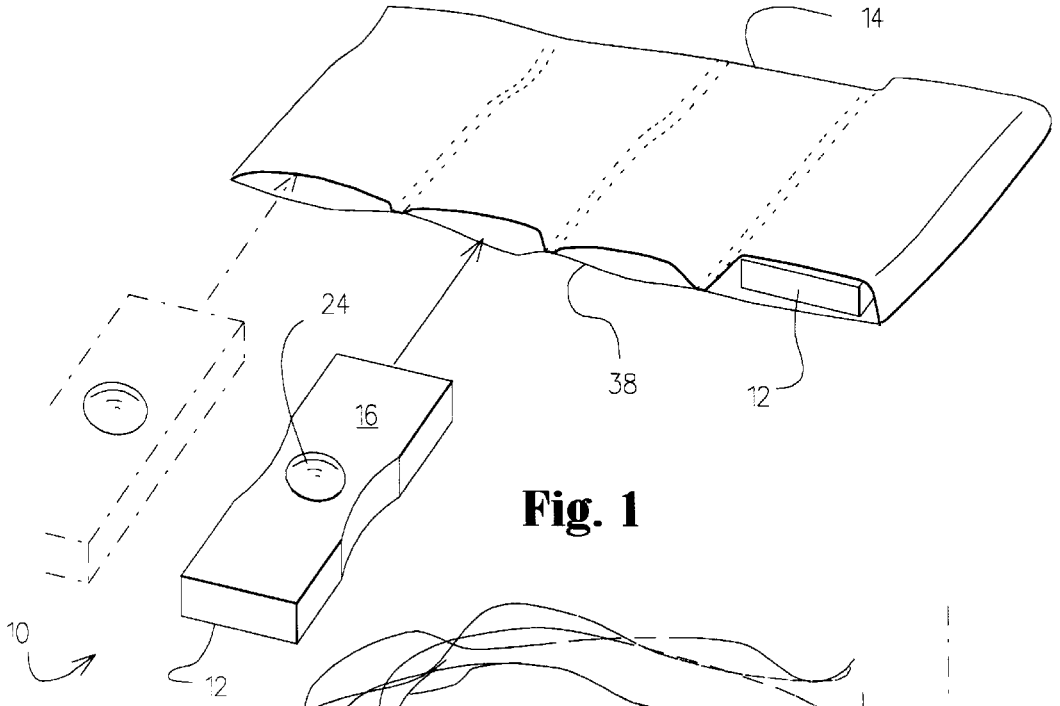
FIG. 1 is a perspective view of an embodiment of the invention, the view illustrating the acceptance of a pillow cushion in a pillow case used with the invention.
Figure 2:
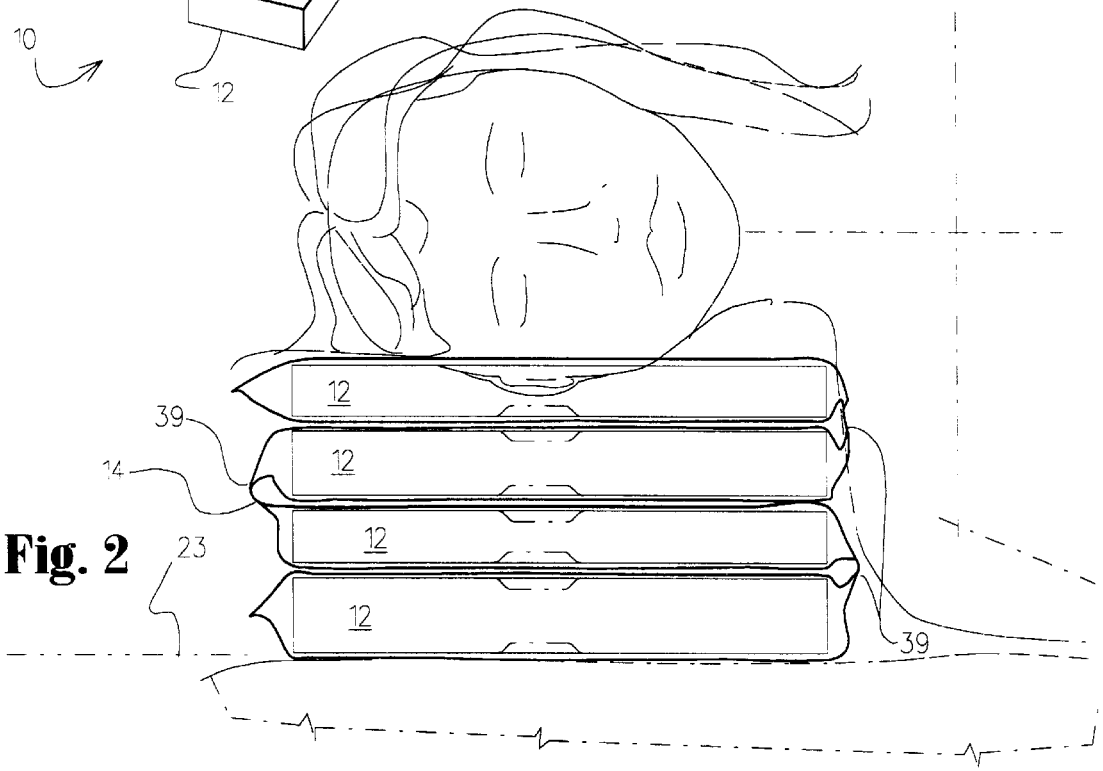
FIG. 2 illustrates the use of a stack of pillow cushions and the accommodation of the user's head within the recess of the uppermost cushion.

Turning now to FIG. 1, where a perspective view of an orthopedic pillow system 10 made in accordance with the principles taught herein has been illustrated. From FIG. 1 it can be understood that the a preferred embodiment of the invention includes a plurality of pillow cushions 12 and means for flexibly securing one pillow cushion 12 relative to another pillow cushion 12. In a preferred embodiment of the invention which has been shown on FIG. 1, the means for flexibly attaching one pillow cushion to another pillow cushion includes a case 14.

Referring now to FIGS. 2 through 6 it will be understood that a preferred embodiment of the invention includes pillow cushions 12 with a body 16 of a desired thickness 18. The body 16 includes a first end 19 and a second end 21, each having a pair of surfaces, preferably an upper surface 20 and a lower surface 22, which are generally parallel to one another. As can be understood from FIG. 2, when a person lays on his side, along a support plane 23, a large proportion of the person's upper body weight is supported through the person's shoulders. This is due to the fact that the shoulders are the most prominent portions of the body, and thus bear against the support plane 23. Unfortunately, however, as the person's shoulder's are supported, the head and neck are left free to dangle from the upper torso area. Known pillow configurations support the head and neck by simply taking up the space between the support plane 23 and the person's head. This solution has been found to be inadequate due to the fact that known pillows do not provide a stable adjustment of the pillow's thickness. Pillows filled with bulk loose materials such as feathers will allow shifting of the fill material, so that the height of the support will fall during the night, leading to a compression of the neck/shoulder relationship and all anatomic structures between. This compression in turn leads to problems such as headaches, neck and shoulder pain, and sleep disturbance.

Figure 3:
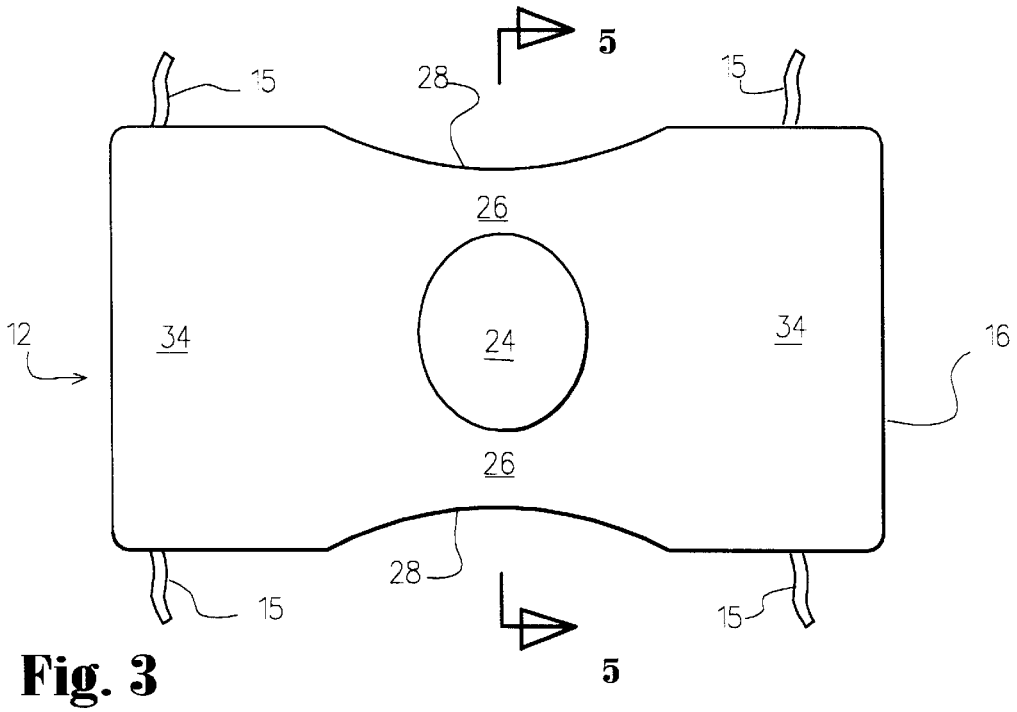
FIG. 3 is a plan view illustrating the shape of a preferred embodiment of the invention.
Figure 4:
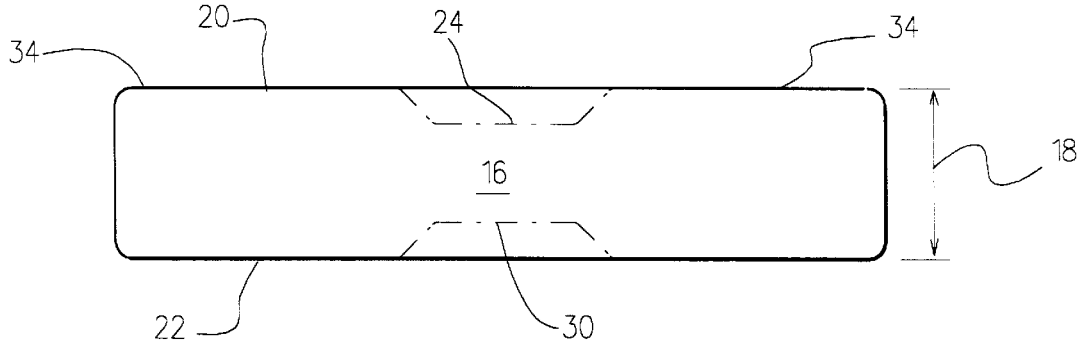
FIG. 4 is a side elevational view of the embodiment shown on FIG. 3.

As shown on FIG. 3, a highly preferred embodiment of the invention solves the problems discussed above by including a first recessed area 24 in at least one of the surfaces of the pillow cushion. The first recessed area 24 preferably begins from a perimeter portion 26 on at least one of the surfaces as shown on FIG. 5. The recessed area 24 should be of a size that allows acceptance of the ear to allow proper blood flow through the ear, while accommodating portions of the head, and achieving other functions described below.

It is important to note that important new and useful results have been achieved by including the recessed area 24. In particular, it has been discovered that the recessed area 24 enhances the pillow system's ability to receive and support the user's head/ear. The narrowed section 28 of the cushion 12 provides the proper distance from the user's shoulder to the user's ear to allow the ear to be accepted into the recessed area 24.

As can be clearly understood from FIG. 3, the shape of the recess area 24 is particularly well suited for receiving the user's head/ear. It is important to note that the recess area 24 plays an important role in providing a balance of providing a structure with the desired rigidity that results in the proper support for the head relative to the rest of the body, while providing an area which does not inhibit blood circulation to the ear or portions of the head being supported.

It has also been discovered that the incorporation of the areas of firm support 34 near the ends of the body 16 of the pillow cushions 12 allows the user to adjust the height of the support with greater precision and stability. Thus, the disclosed system allows replacement and mixing of the individual cushions to establish a desired thickness. Moreover, the use of separate cushions allow the user to change only worn or matted down cushions instead of the entire pillow.

Figure 5:
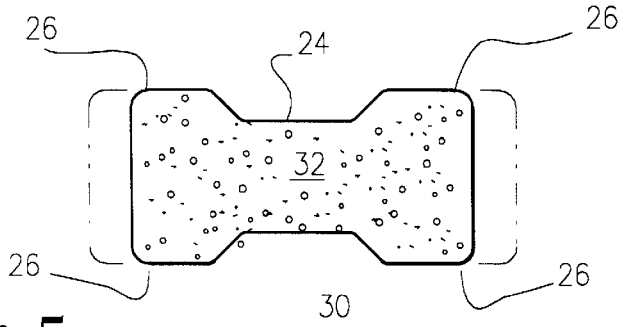
FIG. 5 is an end elevational view of a section the embodiment shown on FIG. 3.
Figure 5A:
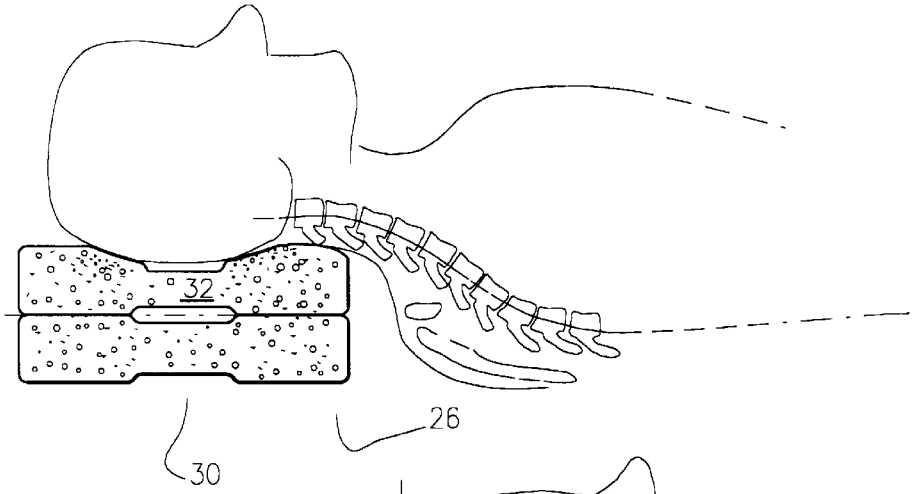
FIG. 5A illustrates the instant invention and the alignment of the spine and shoulder blade area of the user.

Furthermore, as can be understood by referring to FIG. 5, by placing a second recessed area 30, the second recessed area 30 being on the lower surface 22 of the body 16, one establishes an unsupported region 32 between the perimeter edges 26 of the pillow cushion 12. By providing an unsupported region 32 below the recessed area 24 or 30 one effectively reduces the stiffness of the pillow below the recessed areas. The reduction of the stiffness, coupled with the slopes due to deflection of the cushion around the recessed areas will function to keep the user's head and ear positioned over the recessed areas.

Therefore, it is to be understood that the lack of stability of known pillows is another important problem solved by the instant invention. As has been shown on FIGS. 3 and 4, the pillow cushion 12 will preferably include at least two areas of firm support 34 next to the recessed area 24 or 30. The areas of firm support 34 allow the stacking of several pillow cushions 12 in a stable manner. Specifically, when stacking several pillow cushions 12 over one another, the areas of firm support 34 should be aligned with one another. This alignment will provide stability to the stack as well as provide a load path for the transfer of the weight of the user's head and ear and neck down to the mattress or support plane 23.

Figure 6:
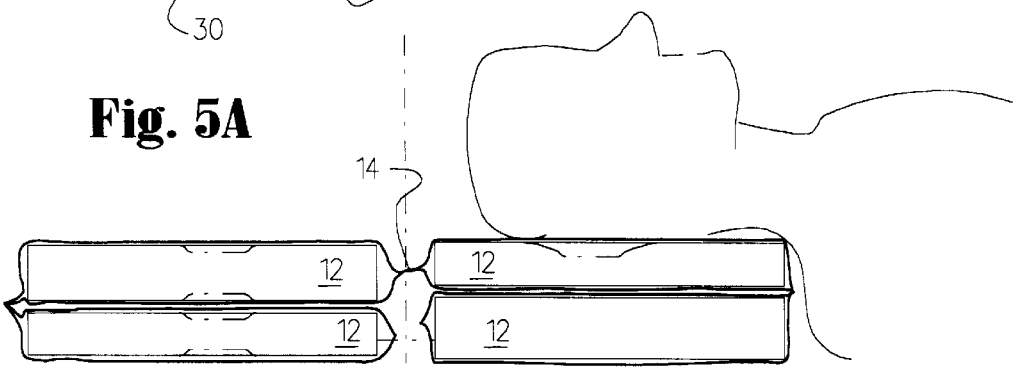
FIG. 6 illustrates the stack of two pillow cushions with the balance of the cushions held away from the user's head

The cooperation between the case 14 and the pillow cushions 12 has been illustrated in FIGS. 6 through 9. In FIG. 6 the pillow system 10 is shown supporting the user's head while the user sleeps on his back. It should be noted that while the preferred embodiment uses a case 14 with a plurality of pockets 38 a side opening 51 and at least one sown side edge 53 to hold the pillow cushions 12 in series with one another, it is also contemplated that one may vary the preferred structure by adding flexible tabs 15, strips or chord, to join one pillow cushion 12 to the next, as shown on FIG. 3. For example, it is contemplated that each pillow cushion 12 may be formed from a housing, from which extend tabs with hook and loop material. These tabs may then be used to attach one pillow cushion 12 to the next, allowing the user to mix or link any desired combination of pillow cushions 12.

Figure 9:
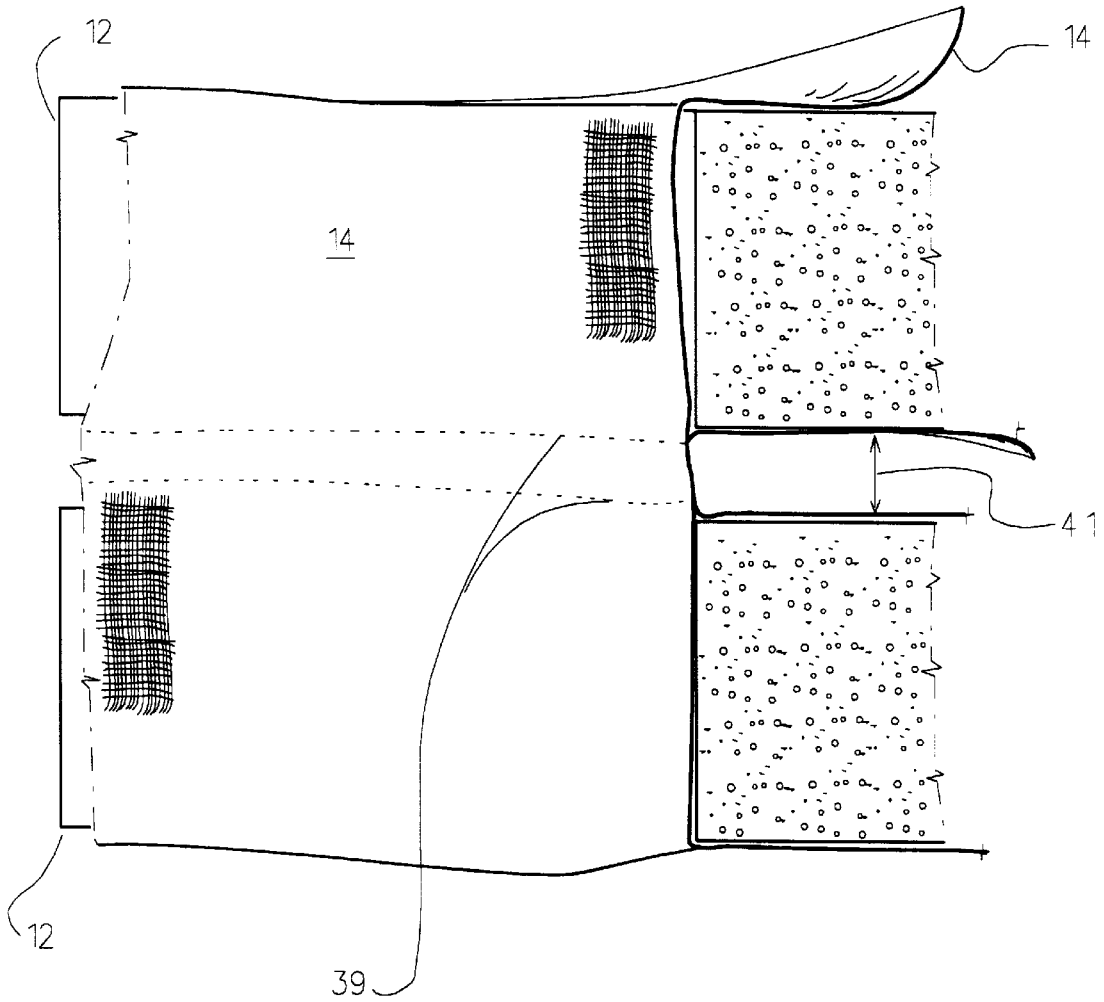
FIG. 9 is a view looking at portions of two sides of a pair of separated cushions to be stacked together. The view illustrates the double stitching of the preferred embodiment of the invention.

As shown on FIG. 9, a preferred embodiment of the invention includes a case 14 in which the sown side edge 53 preferably includes sections of double stitching 39. The sections of double stitching define a section of material that allows for pivoting of one cushion 12 over the next, thus providing a neat, easy folding, structure that avoids bunching of the fabric of the case. The sections of double stitching 39 are preferably placed between the individual pockets 38, thus allowing the placement of one cushion 12 over the next, as indicated by arrow 41, with little effort during the night.

It is important to note that it is contemplated that the disclosed system may be modified without departing from the spirit and scope of the invention. For example, it is contemplated that the body 16 may be made from any of a variety of known soft materials. Thus, while it is contemplated that the body may be formed from foam material, it is also contemplated that the body may be formed by joining several fill-packed baffles next to one another. This would ensure the high density of the fill material at the areas of firm support 34. Additionally, it is contemplated that the recessed area 24 may be formed by placing smaller baffles between the areas of firm support 34.

Still further, while the preferred embodiment of the pillow cushions will include a pair of recessed areas, it is contemplated that the pillow system 10 may include a mixture of pillow cushions, some cushions with one recessed area 24, others with a pair of recessed areas 24 and 30, and still others without recessed areas. These combinations of pillows would allow variation of the stiffness of the stack. The stiffness could be varied, for example, by providing a pillow cushion without a recessed area to support a pillow cushion that includes a recessed area. The pillow cushion with a recessed area 24 being placed over the pillow cushion without a recessed area. This configuration would allow the recessed area to deflect under the weight of the user's head, and then inhibit the further deflection of the recessed area as the recessed area of the upper pillow cushion contacts the lower pillow cushion, which does not have a recessed area.

Additionally, the firmness of a stack of pillow cushions 12 could be varied by simply incorporating a recessed area 24 on a single surface of the body of the pillow cushion 12. The use of a single recessed area 24 produces a thicker, stiffer unsupported area 32.

Figure 7:
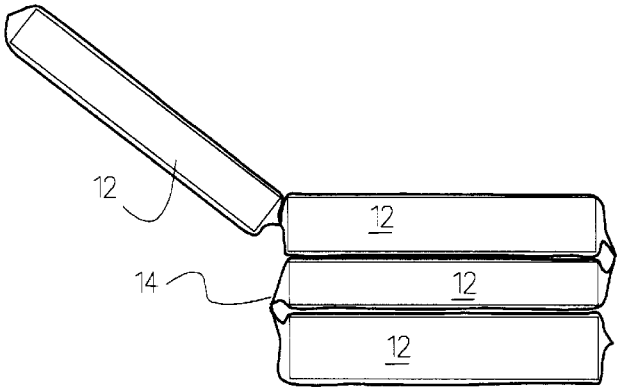
FIG. 7 illustrates yet another stack arrangement.
Figure 8:
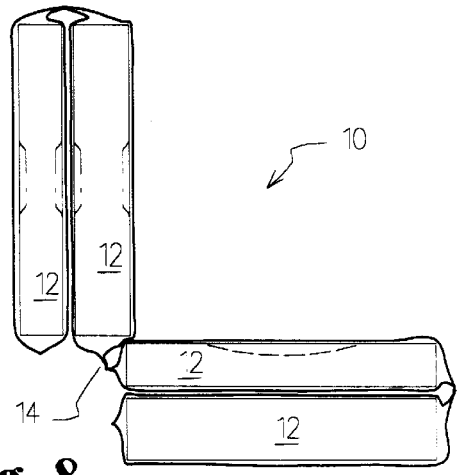
FIG. 8 illustrates the use of the invention as a seat cushion or back support.

Still further, as illustrated in FIG. 7, it will be appreciated that the above embodiments allow use of the pillow system 10 as a cushioning device for a chair or the like. Clearly, by combining pillow cushions with the desired stiffness, one may also customize the support offered by the pillow system 10 when the system is used as a cushioning device over a chair or as a back and head support when using the pillow system to lean against the headboard of a bed.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. An adjustable orthopedic pillow for supporting a user's head in a desired relationship to the user's body, the pillow comprising:

a plurality of pillow cushions comprising an elongated body of stable geometry, the body having:

a first end of a resilient material, the first end having an upper planar surface and a lower planar surface, the upper planar surface being substantially parallel to the lower planar surface, and a recessed area between the upper planar surface of the first end and the upper planar surface of the second end;

a second end of a resilient material, the second end being at a distance from the first end and having an upper planar surface and a lower planar surface, the upper planar surface being substantially parallel to the lower planar surface, and a recessed area between the lower planar surface of the first end and the lower planar surface of the second end; and sides extending between the upper surface of the first end and the lower surface of the first end and the upper surface of the second end and the lower surface of the second end support, so that at least two pillow cushions may be stacked over one another with the first end and second end of each pillow cushion being aligned over one another; and a pillow case having a plurality of pockets with open ends adapted for receiving one of said pillow cushions, each pocket being connected to another pocket in series, so that the cushions will be held in proximity to one another with one side of one cushion held next to the side of another cushion, and so that the cushions may be stacked over one another by rolling one pocket of said pillow case over another pocket of said pillow case.

2. An adjustable orthopedic pillow according to claim 1 wherein each of said pillow cushions further comprises a narrowed section between the sides of the first end and the sides of the second end of the pillow cushions.

3. An adjustable orthopedic pillow according to claim 2 wherein the pockets of said pillow case consist of a side opening and at least one side edge, the side edge connecting one pocket to another pocket, so that a series of succeeding pockets is formed by pockets connected to one another along the edges of the pockets.

4. An adjustable orthopedic pillow according to claim 3 wherein the edges of the pockets of said pillow case consist of a section of spaced apart lines of stitching to define a section of double stitching, the section of double stitching providing a section of material that allows pivoting of one pocket over another pocket of the pillow case, so that the upper surface of the first end and the upper surface of the second end of one pillow cushion will rest over the upper surface of the first end and the upper surface of the second end of a succeeding pillow cushion when one pocket of the pillow case is rolled over the succeeding pocket of the pillow case.

5. An adjustable orthopedic pillow according to claim 4 wherein said pillow case includes at least three pockets connected to one another in series, such that one of the three pockets includes a pair of sections of double stitching, each section of double stitching being shared with an adjacent pocket.

6. An adjustable orthopedic pillow according to claim 4 wherein said pillow case includes at least four pockets connected to one another in series, such that two of the four pockets includes a pair of sections of double stitching, each section of double stitching being shared with an adjacent pocket.

7. An adjustable orthopedic pillow system for supporting a user's head in a desired relationship to the user's body, the pillow system comprising:

a pillow case having a plurality of generally rectangular pockets with open ends, each of the generally rectangular pockets being attached to another succeeding generally rectangular pocket by means of a section of material, such that the longest edge of one rectangular pocket is connected to the longest edge of at least one adjacent generally rectangular pocket by the section of material, the and so that the pockets can fold over one another by pivoting one pocket of said pillow case along the section of fabric to place the pocket over another pocket of said pillow case;

a plurality of pillow cushions of stable geometry, the pillow cushions including an elongated body of a resilient material, the body having:

a first end of a resilient material, the first end having a generally planar upper surface and a generally planar lower surface, the upper surface being substantially parallel to the lower surface;

a second end of a resilient material, the second end having a generally planar upper surface and a generally planar lower surface, the upper surface being substantially parallel to the lower surface, and a concave recessed area between the upper surface of the first end and the upper surface of the second end, and a concave recessed area between the lower surface of the first end and the lower surface of the second end;

sides extending between the upper surface of the first end and the lower surface of the first end and the upper surface of the second end and the lower surface of the second end support, so that at least two pillow cushions may be stacked over one another with the first end and second end of each pillow cushion being aligned over one another; and a narrowed mid-portion, the narrowed mid-portion being smaller than the first end or the second end, so that each pillow cushion is accepted by one of the pockets of the pillow case, and so that the pillow cushions will be held in close proximity to one another by the pillow case with one side of one cushion held next to the side of another cushion, and so that the cushions may be stacked over one another with the recessed area of one cushion resting over the recessed area of another cushion by rolling one pocket of said pillow case over another pocket of said pillow case.

8. An adjustable orthopedic pillow system according to claim 7 wherein the pockets of said pillow case further include a side opening next to at least one side edge, the side edge being connected to the section of material defined by a section of double stitching, the section of material allowing pivoting of one pocket over another pocket of the pillow case, so that the upper surface of the first end and the upper surface of the second end of one pillow cushion will rest over the upper surface of the first end and the upper surface of the second end of a succeeding pillow cushion when one pocket of the pillow case is rolled over the succeeding pocket of the pillow case.

9. An adjustable orthopedic pillow system according to claim 8 wherein said pillow case includes at least three pockets connected to one another in series, such that one of the three pockets includes a pair of sections of double stitching, each section of double stitching being shared with an adjacent pocket.

10. An adjustable orthopedic pillow system according to claim 8 wherein said pillow case includes at least four pockets connected to one another in series, such that two of the four pockets are attached to a pair of sections of double stitching, each section of double stitching being on an opposing edges of the pocket and being shared with an adjacent pocket.

11. An adjustable orthopedic pillow for supporting a user's head in a desired relationship to the user's body, the pillow comprising:

a plurality of pillow cushions comprising an elongated body of unitary construction, the body having:

a first end of a firm material, the first end having a planar upper surface and a planar lower surface, the upper surface being substantially parallel to the lower surface;

a second end of a firm material, the second end having a planar upper surface and a planar lower surface, the upper surface being substantially parallel to the lower surface;

sides extending between the upper surface of the first end and the lower surface of the first end and the upper surface of the second end and the lower surface of the second end support, and a concave recessed area between the upper surface of the first end and the upper surface of the second end, and a concave recessed area between the lower surface of the first end and the lower surface of the second end so that at least two pillow cushions may be stacked over one another with the first end and second end of each pillow cushion being aligned over one another with the recessed area of one cushion resting over the recessed area of another cushion;

a narrowed mid-portion, the narrowed mid-portion connecting the first end and the second end and being smaller than the first end or the second end, the narrowed mid-portion having a concave recess between the upper portion of the first end and the upper portion of the second end; and a pillow case having a plurality of pockets with open ends adapted for receiving one of said pillow cushions, each pocket being next to another pocket series, so that the cushions will be held in close proximity to one another, and so that the cushions may be stacked over one another by rolling one pocket of said pillow case over another pocket of said pillow case.

12. An adjustable orthopedic pillow according to claim 11 and further comprising a second concave recessed area, the second concave recessed area being in the narrowed mid-portion between the lower portion of the first end and the lower portion of the second end.

13. An adjustable orthopedic pillow system according to claim 11 wherein the pockets of said pillow case further include a side opening next to at least one side edge, the side edge being connected to the section of material defined by a section of double stitching, the section of material allowing pivoting of one pocket over another pocket of the pillow case, so that the upper surface of the first end and the upper surface of the second end of one pillow cushion will rest over the upper surface of the first end and the upper surface of the second end of a succeeding pillow cushion when one pocket of the pillow case is rolled over the succeeding pocket of the pillow case.

14. An adjustable orthopedic pillow system according to claim 13 wherein said pillow case includes at least three pockets connected to one another in series, such that one of the three pockets includes a pair of sections of double stitching, each section of double stitching being shared with an adjacent pocket.

15. An adjustable orthopedic pillow according to claim 13 wherein said pillow case includes at least four pockets connected to one another in series, such that two of the four pockets are attached to a pair of sections of double stitching, each section of double stitching being on an opposing edges of the pocket and being shared with an adjacent pocket.

* * * * *